United States Patent [19]

Smith et al.

[11] 4,282,034

[45] Aug. 4, 1981

[54] AMORPHOUS METAL STRUCTURES AND METHOD

[75] Inventors: Jeffery S. Smith, Hamilton; John H. Perepezko, Madison, both of Wis.; Don H. Rasmussen, Canton, N.Y.; Carl R. Loper, Jr., Madison, Wis.

[73] Assignee: Wisconsin Alumni Research Foundation, Madison, Wis.

[21] Appl. No.: 960,100

[22] Filed: Nov. 13, 1978

[51] Int. Cl.[3] ..... B01J 2/02

[52] U.S. Cl. ..... 75/232; 264/6; 264/7; 264/11; 264/82; 75/251

[58] Field of Search ..... 264/6, 7, 11, 82; 75/251, 232

[56] References Cited

U.S. PATENT DOCUMENTS

| | | | |
|---|---|---|---|
| 3,158,474 | 11/1964 | Anderson | 264/111 |
| 3,390,968 | 7/1968 | Brown | 264/111 |
| 4,042,374 | 8/1977 | Rasmussen | 264/5 |

*Primary Examiner*—Donald E. Czaja
*Assistant Examiner*—James R. Hall
*Attorney, Agent, or Firm*—McDougall, Hersh & Scott

[57] ABSTRACT

Bulk shapes and solid structures of amorphous metals formed of micron sized particles produced by droplet emulsion technique whereby undercooled droplets are solidified in the amorphous state with a stabilizing coating on the surfaces thereof, the shapes and solid structures being formed by dispersing the stabilizing coating and bringing the particles into intimate metal to metal contact for atomic bonding, without raising the temperature to crystallization temperature.

4 Claims, 9 Drawing Figures

MAG. 100 X

MAG. 300 X

MAG. 1000 X

MAG. 3000 X

MAG. 1000 X

MAG. 2000 X

MAG. 3000 X

MAG. 100 X

AMORPHOUS METAL STRUCTURES AND METHOD

The Government has rights in this invention pursuant to Grant Nos. DMR 77-13932, ENG 76-15594, and IPA No. 0001 awarded by the National Science Foundation.

This invention relates to the manufacture of bulk shapes and structures of metals in the amorphous or glassy state and to contiguous, solid forms produced thereby.

Considerable interest has developed in amorphous metals and alloys and in the fabrication of products of such metals and alloys in the amorphous state. As described in an article entitled "Fusion Technique May Boost Metallic Glasses" published in the Dec. 19, 1977 issue of Chemical and Engineering News, page 7, their random atomic structure gives these amorphous metals unusual properties. They are much stronger than crystalline metals, some having shear moduli greater than $50\times10^6$ psi units.

Other desirable characteristics are also indicated by such metals and alloys in their amorphous state, such as homogeneity in structures formed thereof, good corrosion resistance, high compression strength, magnetic shielding and the like. These characteristics suggest a number of beneficial uses for such amorphous metals and alloys, such as corrosion resistant coatings, structural shapes and the like. Thus considerable interest has developed in the fabrication of bulk shapes and products of metals and alloys in their amorphous state.

As a result of research conducted at the Lawrence Livermore Laboratories, Dr. Carl F. Cline has succeeded in producing a thin layer of amorphous metal bonded onto a crystalline metal substrate by impacting a thin ribbon of the amorphous metal onto the surface of the substrate with high explosive force. This work is described in the aforementioned publication. The amorphous metal ribbons used by Dr. Cline were prepared by extremely rapid cooling from the molten state to the solid state whereby an organized crystal structure does not develop. Because of the high cooling rate $dT/dt \geqq 10^6$C/sec) needed to produce an amorphous glassy metal, ordinarily at least one dimension must be limited in thickness.

It is an object of this invention to provide a method for producing bulk shapes and structures of amorphous metals which are not limited in their cross section and which do not require impact with explosive force for fabrication of products thereof, but in which bulk shapes and structures of amorphous metals can be produced in a simple and efficient manner without the need for special or expensive equipment, and in which the products are not limited as to size or shape.

Figure 1:
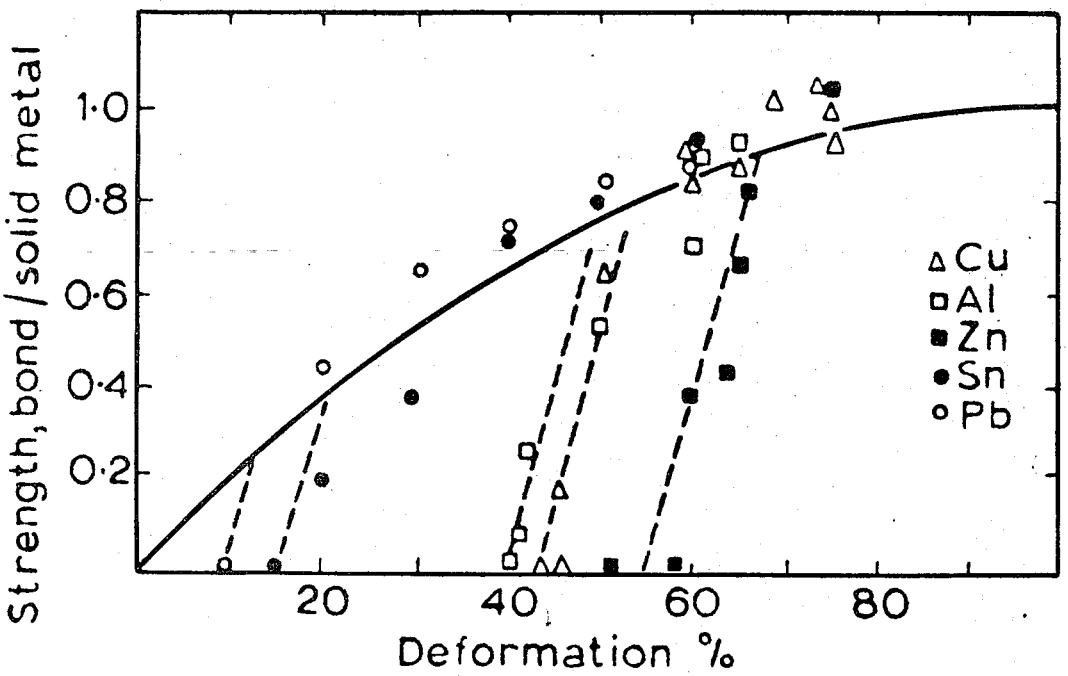
Figure 2:
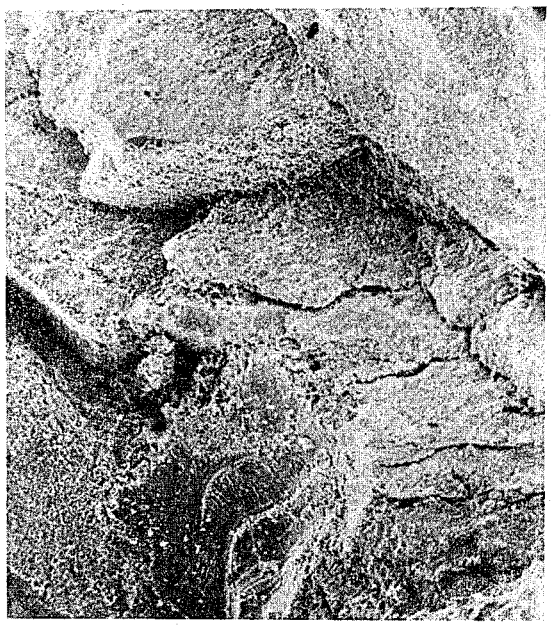
Figure 3:
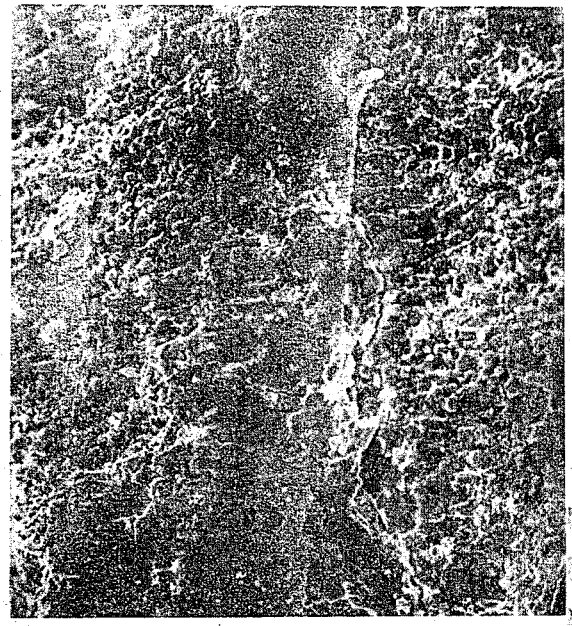
Figure 4:
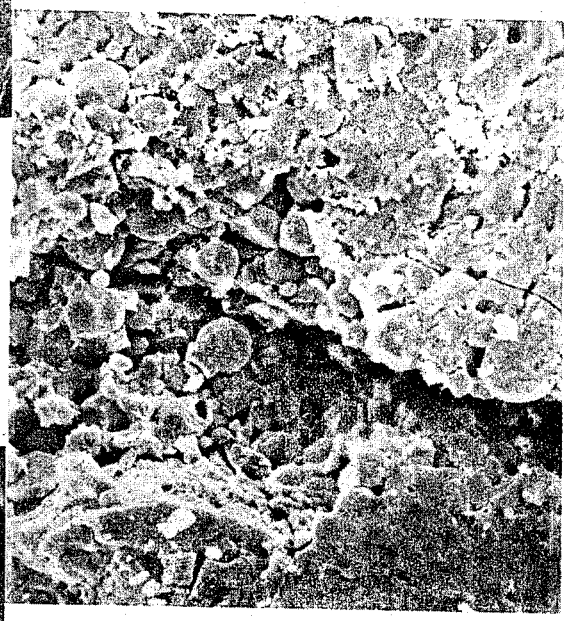

These and other objects and advantages of this invention will hereinafter appear and for purposes of illustration but not of limitation, embodiments of the invention are shown in the accompanying drawings in which:

FIG. 1 is a graph of bond strength versus deformation of a solid metal (prior art); and FIGS. 2-9 are photomicrographs of compacts prepared in accordance with the practice of this invention.

It has been found, in accordance with the practice of this invention, that bulk shapes and structures of high strength and improved mechanical and physical properties can be produced without the need for explosive impact when use is made of particles of undercooled metals in the amorphous state. Such highly undercooled amorphous metals can be made available in large quantities by a technique referred to as a droplet emulsion technique wherein the amorphous metal is produced as fine micron-sized spherical droplets of a dimension which may range from 1-200 μm, with the greater proportion in the range of 1-20 μm, depending somewhat on the method by which the molten metal is reduced to droplet form.

In U.S. Pat. No. 4,042,374, issued Aug. 16, 1977, and entitled "Micron Sized Spherical Droplets of Metals and Method", description is made of the droplet emulsion technique for the preparation of amorphous droplets by dispersion or emulsion of the molten metal in finely divided form in a suitable inert fluid carrier with stabilization of the formed droplets by reaction to form a protective surface, such as an oxide on the surface of the formed metal particles for maintaining the separated relation between the droplets until they become solidified in the carrier fluid.

In accordance with the process described in the issued patent, the molten metal is reduced by shear for emulsification in the fluid carrier containing a reactant to form the layer of metal oxide or other protective reaction product on the surfaces of the droplets of molten metal before the particles are cooled below the melting point.

The number of metals that can be processed by the droplet technique can be expanded to include higher melting point metals and superalloys by employing an inert gas or metal salt as the carrier fluid in which the molten metal is emulsified or by making use of an inert gas as the carrier fluid in which the molten metal can be dispersed as fine droplets as by the use of a spinning disc or as by impact of a metal in a molten stream with the inert gas flowing at a momentum considerably greater than the momentum of the molten metal stream whereby the metal in the stream is broken down into fine spherical droplets which become entrained with the gases stream for quenching. The reactant to produce the oxide or other protective surface is introduced with the carrier gas, and preferably as a separate gas introduced at the point of dispersion of the metal droplets into the carrier gas for reaction to form the protective coating before the metal droplets are quenched. The described droplet emulsion technique maximized the undercooling phenomena by removing catalytic nucleation sites for crystallization, thereby permitting the molten metal droplets to undercool to the amorphous state. The amorphous metal droplets is generally in the form of spherical particles having a diameter within the range of 1-200 μm and preferably in the range of 1-20 μm.

Such amorphous metals are non-crystalline solids, i.e., they solidify continuously from the liquid without discontinuous release of latent heat. This results from a large increase in the viscosity ($10^9$ to $10^{13}$ poise in a range of 10° C.) as the liquid is cooled through the glass transition temperature $T_g$. Their X-ray diffraction pattern is similar to that of a liquid in that there are broad, diffuse peaks rather than sharp, well-defined peaks characteristic of a crystalline solid.

Such amorphous metals become thermally unstable and convert to their crystalline form when heated to a temperature above their $T_c$ (crystallization) temperature. Thus, in the preparation of bulk shapes and structures of the described amorphous metals, it is necessary to operate in a temperature range below the crystallization temperature. At the same time, in order to obtain interbonding of the amorphous particles, it has been found necessary to obtain intimate metal to metal contact so that bonding can occur at the interface between particles In order to achieve the desired conditions for bonding it is important to break down or to disperse the stabilizing layer present on the surfaces of the amorphous metal particles in order to produce bulk shapes and structures by bonding. Such breakdown or displacement of the oxide or other protective layer can be achieved by mere deformation of the particles. The plot in FIG. 1 of strength bond/solid metal versus deformation, L. R. Vaidyanath, M. G. Nickolas and V. R. Miller, British Welding Journal, Vol. 6, pp. 13–28 (1959), indicates that there is a threshold value of deformation for each metal below which bonding will not occur. The differences in values reflect the ease or difficulty of breaking through the oxide or other stabilizing surface film and dispersing it sufficiently to enable bonding. The amount of deformation or threshold value can be reduced by providing for relative motion between the surfaces of the particles to be bonded in order to obtain the desired bond strength. The effect of surface contaminants is to increase the threshold deformation for initiation of bonding initiation. Thus bulk shapes and structures of metals in their amorphous state can be produced by the application of shear forces to achieve flow during bonding. This is clearly distinguishable from reliance on purely compressive forces as by impacting of the amorphous particles onto a surface with explosive force to form a thin bonded layer of the amorphous particles on the surface.

The preparation of continguous solid structures of amorphous metals, in accordance with the practice of this invention, will now be illustrated by way of the following examples:

EXAMPLE 1

Amorphous Cu 29 At. (Atomic)% Te 71 At. % powder produced by the described droplet emulsion technique was ultrasonically cleaned in acetone and pure methanol to remove surface contaminants. The cleaned powder was dried in an argon atmosphere. The powder was loaded and vibro-compacted in a copper tube that was blocked at both ends with copper pins. The filled tube was then swaged at room temperature through three dies to an outside diameter of 0.108 inches and then cut into lengths of ¾ inch.

A ¾ inch section was impacted by a 40 pound guided hammer on a dynamic tear machine. The hammer was dropped from 1.75 feet to provide a maximum energy impacted on the test specimen equal to 70 ft. lb. Another section was impacted at 60 ft. lb. The specimen impacted at 70 ft. lb. was deformed to a thickness of 0.036 inch and the specimen impacted at 60 ft. lb. was deformed to a thickness of 0.046 inch.

The copper sheath was removed from the impacted specimens as well as from a swaged specimen without impacting. The compacts were then examined with a JSM-3 scanning electron microscope and the 70 ft. lb. specimen was X-rayed on a Picker X-ray diffractometer.

The X-ray diffractometer trace of the 70 ft. lb. compact confirmed that it was still amorphous.

Figure 5:
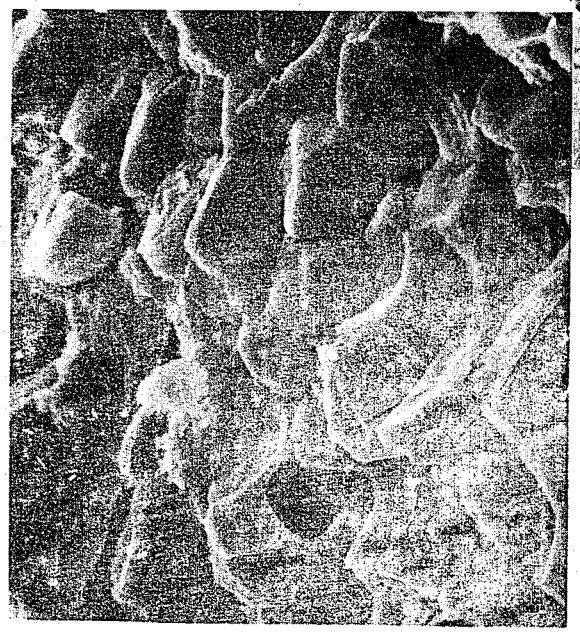

The scanning electron microscope examination clearly revealed the various stages that the powder goes through in the welding process. FIGS. 2–5 show various areas of the swaged compact after it was fractured with magnifications progressing from 100 times (FIG. 2) to 3,000 times (FIG. 5). The figures show that the swaging tends to form areas of highly densified material as well as porosity. FIG. 5 shows an initiation of welding as the droplets become extensively deformed.

Figure 6:
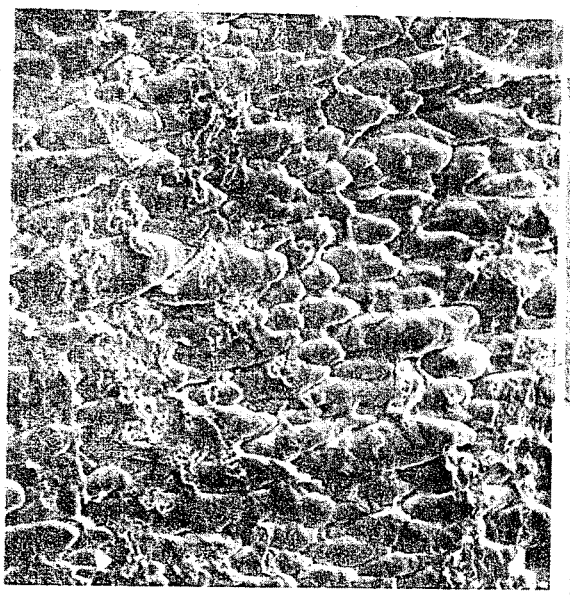
Figure 7:
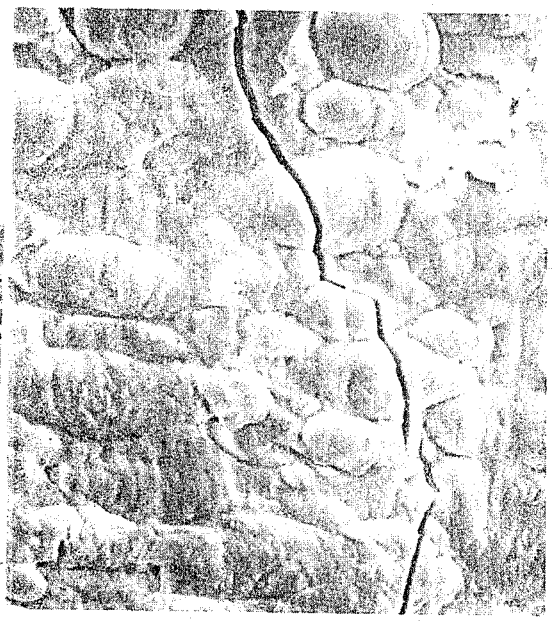
Figure 8:
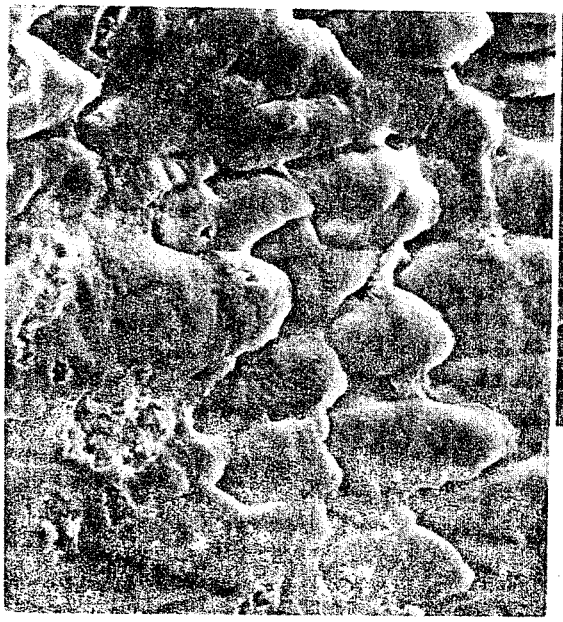

FIGS. 6 through 8 are of the outer edge of the 70 ft. lb. specimen and show a further stage in the compaction process. Because of the change in cross section geometry from the swaging (circular) to the impacted (rectangular), the outer edge of the impacted specimens were not deformed as much as the center. This provided an opportunity to observe the change in welding as deformation increased toward the center of the specimen. It will be noted from FIG. 7 that the crack does not follow prior particle boundaries but instead cuts through deformed particles. This is indicative of the fact that the welded areas approach the strength of the particles themselves.

Figure 9:
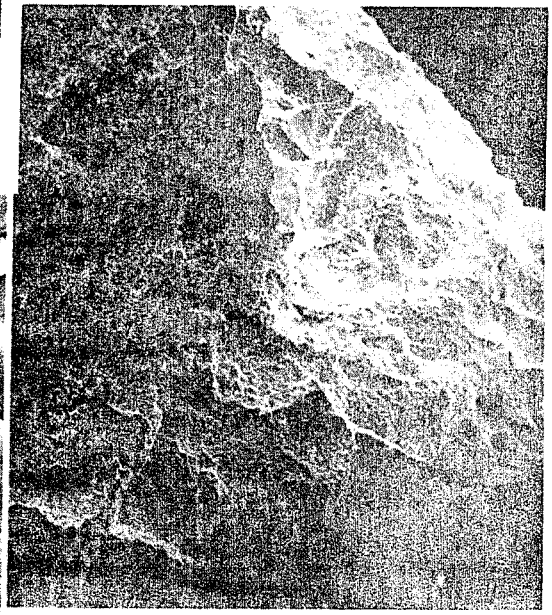

FIG. 9 is a low magnification view of the compact in which no discrete particles are visible. This indicates that the deformation has been sufficiently complete so that prior particle boundaries have been substantially completely eliminated.

EXAMPLE 2

Particles of Cu 29 At. % Te 71 At. % alloy were formed by the described droplet emulsion technique by emulsification with surface treatment to achieve the desired degree of undercooling for vitrification to provide glassy or amorphous particles of a size within the range of 5–20 μm.

The particles were ultrasonically cleaned in acetone and methanol to remove surface contaminants. The particles were then loaded into a piston and die arrangement, fitted with a resistance heater, and subjected to normal compressive stress.

Compacts were produced at pressures from 24,000 psi to 100,000 psi, and temperatures ranging from room temperature to about 100° C. The compacts were solid, uniform, shiny discs indicating that extensive flow had occurred, especially at the juncture between the compact and the die wall where shear forces would be expected to be maximized. X-ray diffraction, analysis of the compacts confirmed they were still amorphous when compacted below the crystallization temperature $T_c$.

This identifies certain parameters as significant in the deformation and compaction of amorphous metal droplets to form solid structures. Flow and the deformation of amorphous droplets is accomplished most effectively under the action of shear forces. If the deformation is substantial, fracture of individual particles will occur. The effect is beneficial to the compaction since additional surface is thereby provided for the bonding. Observations indicate that an increase in the rate of deformation promotes more extensive flow and subsequent bonding.

It is important that all working operations be carried out at a temperature below the crystallization temperature of the amorphous particles in order to achieve a maximum degree of compaction while maintaining the amorphous state.

The described process lends itself to the production of bulk shapes and structures of amorphous metals and alloys without limitation as to size or shape and to a process which is adaptable to a continuous production schedule.

The undercooled amorphous particles produced by droplet emulsion technique makes amorphous particles available in large quantities, at a relatively low cost, for use in the fabrication of parts and structures having the advantages and characteristics of the amorphous metal.

As long as sufficient deformation for dispersion of the protective coating on the amorphous particles is obtained, the amount of deformation for bonding is not critical. With some metals and alloys, a 10% deformation is sufficient while deformation up to 80% can be used as is desirable for other metals, such as Fe.

It will be understood that changes may be made in the details of the formulation and operation without departing from the spirit of the invention, especially as defined in the following claims.

We claim:

1. In the method of producing amorphous metal structures from amorphous metal particles produced by
   (a) emulsifying the metal as droplets in a molten state in an inert carrier fluid,
   (b) reacting the molten metal while in the emulsified state in the fluid to form a reaction product on the surface of the metal droplets which stabilizes the metal droplets in the emulsion,
   (c) cooling the emulsion whereby the metal droplets solidify as particles of undercooled metal in the amorphous state, and
   (d) separating the undercooled amorphous metal particles, the improvement comprising:
      (1) compressing the particles while deforming the particles to apply shear and compressive forces to said particles to expose the amorphous metal interior of the reaction product on the surface of the particles while at a temperature below recrystallization temperature of the metal to avoid recrystallization, whereby the exposed amorphous metal of the particles interbond with each other to form a solid amorphous metal structure.

2. The method as claimed in claim 1 in which the reaction product on the surface of the metal particles is a metal oxide.

3. The method as claimed in claim 1 in which the particles are in the form of micro-sized spherical particles having a diameter within the range of 1–200 μm.

4. A product of the process of claim 1.

* * * * *

UNITED STATES PATENT AND TRADEMARK OFFICE

CERTIFICATE OF CORRECTION

PATENT NO. : 4,282,034

DATED : August 4, 1981

INVENTOR(S) : Jeffery S. Smith et al.

It is certified that error appears in the above—identified patent and that said Letters Patent is hereby corrected as shown below:

The Figure on the title page should appear as shown below.

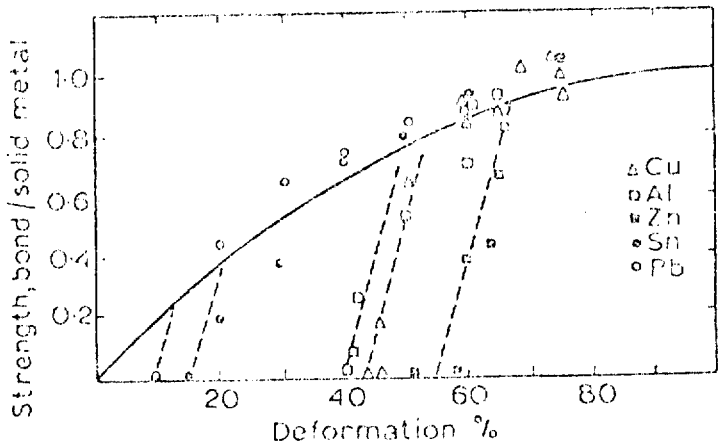

Signed and Sealed this

*Seventeenth* Day of *November 1981*

[SEAL]

*Attest:*

GERALD J. MOSSINGHOFF

*Attesting Officer*

*Commissioner of Patents and Trademarks*